US006877483B2

(12) United States Patent
Askew

(10) Patent No.: US 6,877,483 B2
(45) **Date of Patent: *Apr. 12, 2005**

(54) FUEL INJECTOR ARRANGEMENT

(76) Inventor: James Martin Anderton Askew, Lower Washwall Lane, Painswick, Stroud, Gloucestershire GL6 6XW (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/525,640

(22) Filed: Mar. 14, 2000

(65) Prior Publication Data

US 2002/0148905 A1 Oct. 17, 2002

(30) Foreign Application Priority Data

Mar. 16, 1999 (GB) ..... 9905896

(51) Int. Cl.[7] ..... F02M 41/00
(52) U.S. Cl. ..... 123/467; 123/514
(58) Field of Search ..... 123/467, 447, 123/456, 446, 514, 496

(56) References Cited

U.S. PATENT DOCUMENTS

| | | | | | |
|---|---|---|---|---|---|
| 3,800,754 | A | * | 4/1974 | Carlson et al. | 123/73 CB |
| 4,603,671 | A | * | 8/1986 | Yoshinaga et al. | 123/467 |
| 4,784,101 | A | * | 11/1988 | Iwanaga et al. | 123/446 |
| 5,626,119 | A | * | 5/1997 | Timms | 123/467 |
| 5,732,679 | A | * | 3/1998 | Takahasi et al. | 123/467 |

FOREIGN PATENT DOCUMENTS

| | | |
|---|---|---|
| DE | 2759255 | 7/1979 |
| DE | 19715234 | 6/1988 |
| EP | 1079096 | 2/2001 |

* cited by examiner

*Primary Examiner*—Willis R. Wolfe
*Assistant Examiner*—Mahmoud Gimie

(57) ABSTRACT

A fuel injector arrangement comprising a nozzle provided with a first bore within which a valve needle is slidable, the needle being engageable with a seating to control the flow of fuel from a delivery chamber to an outlet opening. The arrangement includes a surface associated with the needle which is exposed to the fuel pressure within a control chamber, and a fuel pressure actuable control valve controlling the supply of fuel to the delivery chamber.

22 Claims, 6 Drawing Sheets

FUEL INJECTOR ARRANGEMENT

TECHNICAL FIELD

This invention relates to a fuel injector arrangement for use in delivering fuel under pressure to a combustion space of an internal combustion engine. The invention relates, in particular, to a fuel injector arrangement suitable for use in a fuel system of the common rail type.

BACKGROUND OF THE INVENTION

In a known common rail fuel injector, a valve needle is engageable with a seating to control the delivery of fuel to a combustion space. The position of the needle is controlled by controlling the fuel pressure within a control chamber. In such an arrangement, in the event that the valve needle becomes stuck in a lifted position, fuel will be delivered continuously by the injector. Such a continuous discharge of fuel under pressure could cause a catastrophic failure of the engine and/or fuel system.

An alternative arrangement comprises a valve needle spring biased towards a seating, and a control valve controlling the supply of fuel to a delivery chamber of the injector. In such an arrangement, if the control valve sticks in an open position, fuel delivery will occur continuously and may result in failure as described hereinbefore.

It is an object of the invention to provide an injector in which the disadvantages described hereinbefore are obviated or mitigated.

SUMMARY OF THE INVENTION

According to the present invention there is provided a fuel injector arrangement comprising a nozzle provided with a bore within which a valve needle is slidable, the needle being engageable with a seating to control the flow of fuel from a delivery chamber to an outlet opening, a surface associated with the needle being exposed to the fuel pressure within a control chamber, and a fuel pressure actuable control valve controlling the supply of fuel to the delivery chamber.

Such an arrangement is advantageous in that continuous delivery of fuel requires both the needle to become stuck in a lifted position and the control valve to become stuck in an open position. The risk of continuous fuel delivery and the associated risk of damage to the engine and fuel system are thereby reduced.

A solenoid actuable valve is conveniently provided to control the fuel pressure within the control chamber, thereby controlling the timing of movement of the valve needle. The solenoid actuable valve may also control the fuel pressure applied to the fuel pressure actuable control valve.

The fuel pressure actuable control valve and the solenoid actuable valve are conveniently mounted upon or form part of a fuel injector of which the nozzle forms part.

BRIEF DESCRIPTION OF THE DRAWINGS

The invention will further be described, by way of example, with reference to the accompanying drawings, in which.

DESCRIPTION OF THE PREFERRED EMBODIMENT

Figure 1:
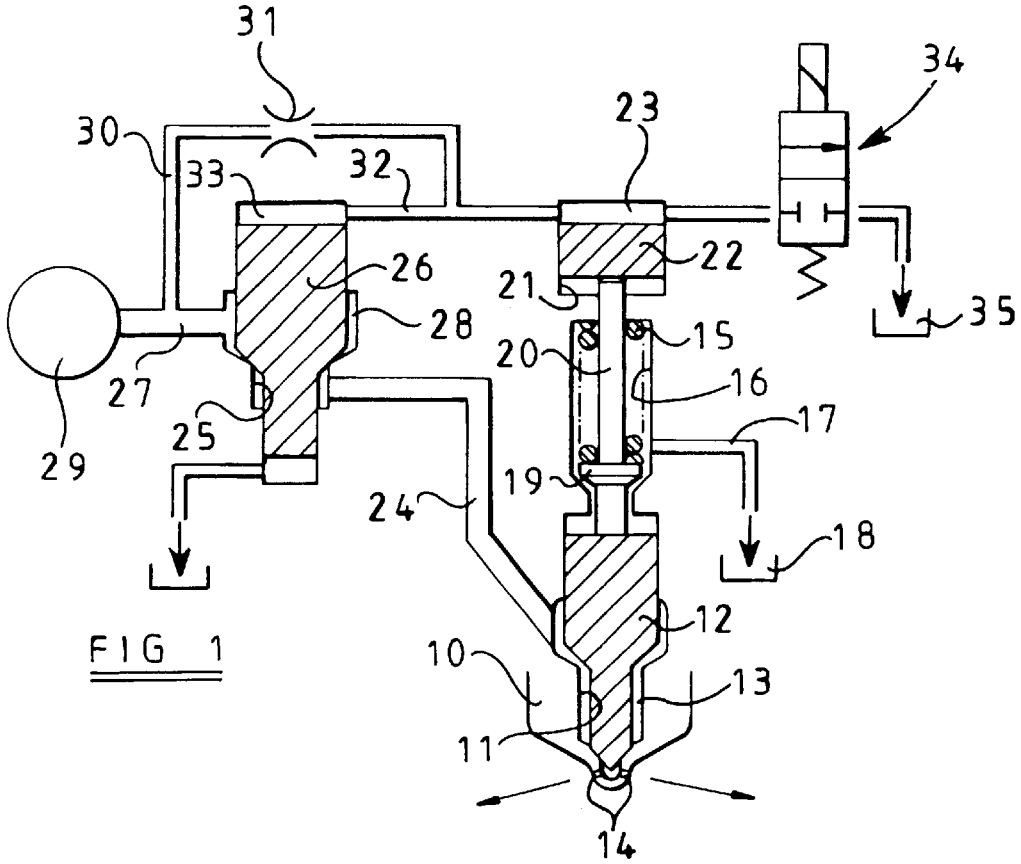
FIG. 1 is a diagrammatic view illustrating a fuel injector arrangement in accordance with an embodiment of the invention.

The fuel injector arrangement illustrated, somewhat diagrammatically, in FIG. 1 comprises a nozzle body 10 within which a blind bore 11 is formed. A valve needle 12 is slidable within the bore, the needle 12 including an enlarged diameter region the dimensions of which are, in relation to those of the bore, such that the bore 11 guides the needle 12 for sliding movement therein. The bore 11 defines, adjacent its blind end, a seating with which a tip region of the needle 12 is engageable to control fuel delivery from a delivery chamber 13 defined upstream of the seating to a plurality of outlet openings 14 which communicate with the bore 11 downstream of the seating.

The needle 12 is biased into engagement with the seating by a spring 15 located within a spring chamber 16 which is vented through a passage 17 to an appropriate low pressure fuel reservoir 18. The spring 15 abuts a spring abutment member 19 which engages the upper surface of the needle 12 to transmit the force applied by the spring 15 to the needle 12. The spring abutment member 19 includes a load transmitting member 20 which extends into a chamber 21 within which a piston member 22 is slidable. The upper surface of the piston member 22 is exposed to the fuel pressure within a control chamber 23, the piston member 22 being orientated such that the application of fuel under high pressure to the control chamber 23 applies a force to the needle 12 urging the needle 12 towards its seating.

The delivery chamber 13 communicates through a passage 24 with a bore 25 within which a control valve member 26 is slidable. The control valve member 26 is engageable with a seating defined by the bore 25 to control communication between a passage 27 which opens into a chamber 28 immediately upstream of the seating, and the passage 24. The passage 27 communicates, in use, with a source 29 of fuel under high pressure, for example, the common rail of a common rail fuel system which is charged to an appropriately high pressure by a suitable high pressure fuel pump.

The passage 27 communicates through a passage 30, which is provided with a flow restriction 31, with a passage 32 which opens both into the control chamber 23 and a chamber 33 which is defined, in part, by the upper end surface of the control valve member 26. The control valve member 26 is arranged such that the application of fuel under pressure to the chamber 33 applies a force to the control valve member 26 urging the control valve member 26 into engagement with its seating to prevent communication between the source 29 and the delivery chamber 13.

An electromagnetically actuable valve 34 is provided to control communication between the control chamber 23, and hence the chamber 33, and a suitable low pressure drain reservoir 35.

In the position illustrated in FIG. 1, the control valve 34 is spring biased to a position in which the control chamber 23 does not communicate with the low pressure drain reservoir 35. As a result of the communication between the source 29 and both the control chamber 23 and the chamber 33, the chamber 33 and the control chamber 23 are both pressurized to a high level. As a result, the control valve member 26 is urged into engagement with its seating, and so fuel is not supplied to the delivery chamber 13. Further, the fuel pressure within the control chamber 23 together with the action of the spring 15 ensure that the valve needle 12 engages its seating, and so fuel delivery through the injector does not take place.

When fuel injection is to take place, the electromagnetically actuable valve 34 is energized to move the valve member thereof to a position in which communication is permitted between the control chamber 23 and the low pressure drain reservoir 35. As a result, fuel is able to escape from the control chamber 23, and as the rate at which fuel is able to flow to the control chamber 23 is restricted by the restriction 31, the fuel pressure within the control chamber 23 falls. The fuel pressure within the chamber 33 also falls as a result of the communication between the chamber 33 and the control chamber 23 and as a result of the presence of the restriction 31.

The fuel pressure within the chamber 33 will fall to a level sufficient to permit the valve member 26 to lift away from its seating due to the action of the fuel pressure within the chamber 28 upon the exposed, angled surfaces of the control valve member 26. The movement of the valve member 26 permits fuel from the source 29 to flow through the passage 24 to the delivery chamber 13, pressurizing the delivery chamber 13.

The increase in fuel pressure within the delivery chamber 13 applies an upwardly directed force to the needle 12 which will rise to a level sufficient to overcome the action of the remaining fuel pressure within the control chamber 23 and the action of the spring 15, lifting the valve needle 12 away from its seating and thus permitting fuel to flow through the outlet openings 14 to a combustion space of an associated engine.

In order to terminate injection, the electromagnetically actuable control valve 34 is returned to the position illustrated. As a result, fuel is no longer able to flow from the control chamber 23 to the low pressure fuel reservoir 35, and as fuel is able to flow through the restriction 31, albeit at a restricted rate, the fuel pressure within the chamber 33 and the control chamber 23 will rise. A point will be reached beyond which the action of the fuel under pressure within the control chamber 23 in combination with the action of the spring 15 will be sufficient to return the valve needle 12 into engagement with its seating, thus terminating the delivery of fuel from the delivery chamber 13 through the outlet openings 14. The increase in fuel pressure within the chamber 33 will serve to apply an increased force to the control valve member 26 urging the control valve member 26 towards its seating, and a point will be reached beyond which the control valve member 26 engages its seating, thus terminating the supply of fuel from the source 29 to the delivery chamber 13. As illustrated in FIG. 1, part of the lower end of the control valve member 26 is shielded from fuel under pressure at all times thus, when fuel under pressure is applied to the chamber 33, the valve member 26 is urged towards its seating.

If the arrangement is to be used in a system in which a pilot injection is to be delivered prior to a main injection, during each injection cycle, then the injection operation is repeated to permit delivery of the main injection.

It will be appreciated that the arrangement described hereinbefore is advantageous in that, in the event that the needle 12 becomes jammed or stuck in a lifted position, then, when termination of injection is to occur, switching of the electromagnetically actuated valve 34 will cause the fuel pressure within the chamber 33 to rise, causing the valve member 26 to move into engagement with its seating, thereby terminating the supply of fuel to the delivery chamber 13. As a result, even though the needle 12 is stuck in a lifted position, as the supply of fuel to the delivery chamber 13 is terminated, continuous injection will not occur. Similarly, if the valve member 26 becomes jammed in a lifted position, operation of the electromagnetically actuated valve 34 to terminate injection will cause the fuel pressure within the control chamber 23 to rise thereby ensuring that, provided the valve needle 12 is not stuck in a lifted position, the valve needle will move into engagement with its seating, terminating injection. It will be appreciated that continuous injection of fuel from the source 29 will only occur in the event that both the valve needle 12 and the control valve member 26 become stuck in their lifted positions.

In FIG. 1, the valve member (26) and the piston member (22) are located side by side, whereas in practice it may be preferable to align the valve member (26) with the piston member (22) such that one is located behind the other.

Figure 2:
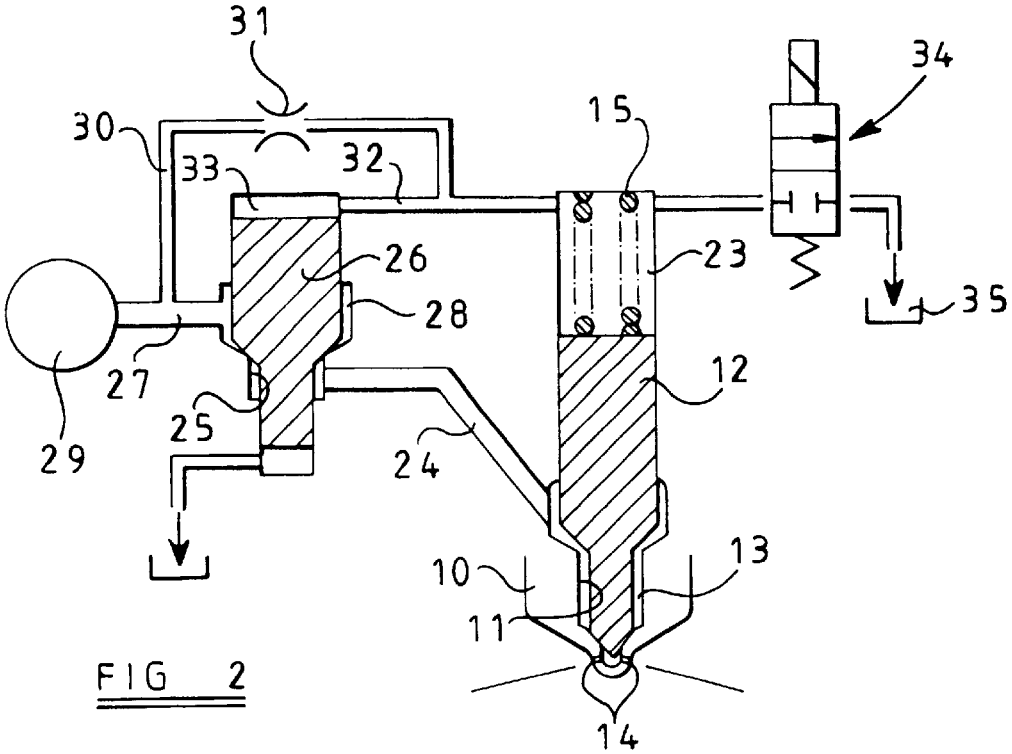
FIGS. 2 to 4 are views similar to FIG. 1 illustrating further embodiments.

FIG. 2 illustrates an arrangement which is similar to that of FIG. 1, but differs therefrom in that rather than providing a separate piston member 22 which is exposed to the fuel pressure within the control chamber 23, the upper end surface of the needle 12 is exposed to the fuel pressure within the control chamber 23, the spring 15 being located within the control chamber 23. Operation of this embodiment is as described hereinbefore, and so will not be described in further detail. In the arrangement of FIG. 2, the effective area of the surface associated with the needle 12 exposed to the fuel pressure within the control chamber 23 is reduced compared to that of FIG. 1. As a result, the force applied to the needle 12 by the fuel pressure within the control chamber 23 is reduced, and so in order to ensure rapid closing of the injector at the termination of injection, a flow restrictor may be provided in the passage 24 to restrict the rate at which fuel can flow to the delivery chamber 13 so that, during injection, the fuel pressure within the delivery chamber 13 falls, thereby reducing the net upward force applied to the needle 12. If desired, the restriction may be located immediately upstream of the control valve or be constituted by the control valve.

Figure 3:
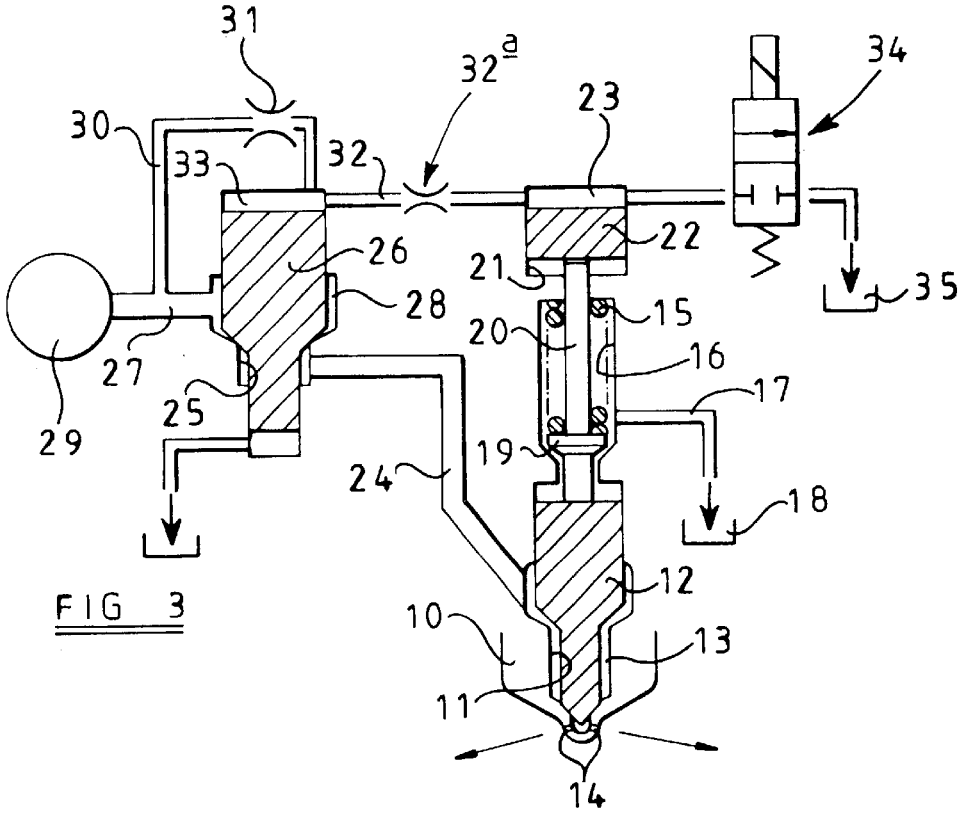

FIG. 3 illustrates an arrangement which, in many respects, is similar to that of FIG. 1, and only the differences between the arrangement of FIG. 1 and that of FIG. 3 will be described in detail. In the arrangement of FIG. 3, the passage 30 communicates directly with the chamber 33 rather than with the passage 32 located between the chamber 33 and the control chamber 23, and the passage 32 is provided with a restriction 32*a* restricting the rate at which fuel is able to flow from the chamber 33 to the control chamber 23.

In use, prior to commencement of injection, both the chamber 33 and the control chamber 23 are at high pressure, and so large forces are applied to the control valve member 26 and the valve needle 12 ensuring that they engage their respective seatings to ensure that fuel is not permitted to flow to the delivery chamber 13 and to ensure that fuel injection does not take place. In order to commence injection, the electromagnetically actuated valve 34 is energized to move the valve member thereof to a position in which communication is permitted between the control chamber 23 and the low pressure fuel reservoir 35. The fuel pressure within the control chamber 23 therefore falls, the rate at which fuel is able to flow towards the control chamber 23 being restricted by the restriction 31 and the restriction 32*a*. The fuel pressure within the chamber 33 also falls, fuel being permitted to flow from the chamber 33 at a restricted rate through the restriction 32*a*, fuel flow to the chamber 33 being restricted by the restriction 31. As a result of the fall in pressure within the chamber 33 and the control chamber 23, the valve member 26 and the valve needle 12 are able to lift from their seatings thus permitting fuel supply to the delivery chamber 13 and through the outlet openings 14.

In order to terminate injection, the electromagnetically actuated valve 34 is returned to the position illustrated. As a result, the fuel pressure within the chamber 33 and the control chamber 23 will rise. The provision of the restriction 32*a* and the communication of the passage 30 directly with the chamber 33 ensures that the fuel pressure within the chamber 33 rises more quickly than that within the control chamber 23. As a result, the valve member 26 moves into engagement with its seating, thus terminating the supply of fuel to the delivery chamber 13 prior to the valve needle 12 moving into engagement with the seating to terminate the delivery of injection through the outlet openings 14. It will be understood that the rates at which the respective valve members move depend not only upon the pressure present in the respective control chamber, but also upon the effective area of the valve member exposed to the pressure in its control chamber.

Figure 4:
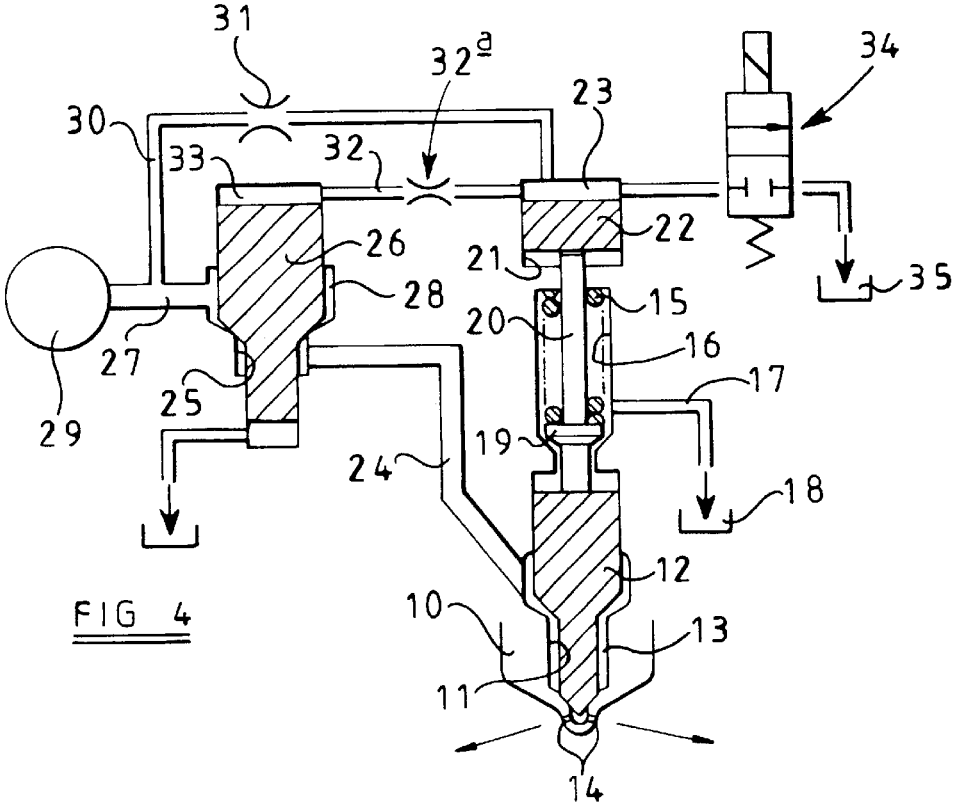

FIG. 4 illustrates an arrangement which is similar to that of FIG. 3, but in which the passage 30 communicates directly with the control chamber 23. As a result, upon de-energization of the electromagnetically actuated valve 34 to terminate injection, the fuel pressure within the control chamber 23 will rise more rapidly than that within the chamber 33, thus the needle 12 will return into engagement with its seating prior to movement of the valve member 26 occurring to terminate the supply of fuel to the delivery chamber 13. Such an arrangement is particularly advantageous where short injection events are desired, for example where each injection cycle is to include an initial, pilot injection in which a small quantity of fuel is delivered, the pilot injection being followed by a main injection. In such a case, depending upon the operating conditions, the control valve member may be arranged to remain spaced from its seating between the pilot and main injections, the pressure within the chamber 33 not reaching a high enough level for a long enough duration to cause movement of the valve member 26 into engagement with its seating between the pilot and main injections.

Figure 8:
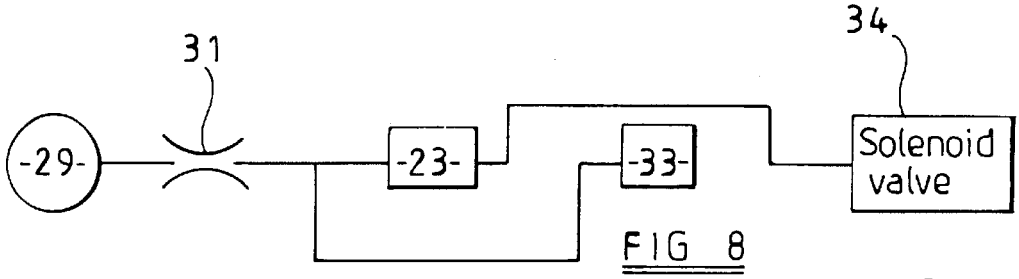
FIGS. 8, 9 and 10 are schematic views of the arrangement of FIGS. 1, 3 and 4 respectively.
Figure 9:
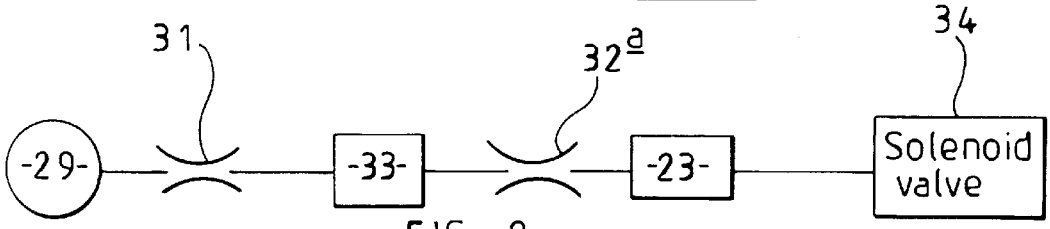
Figure 10:
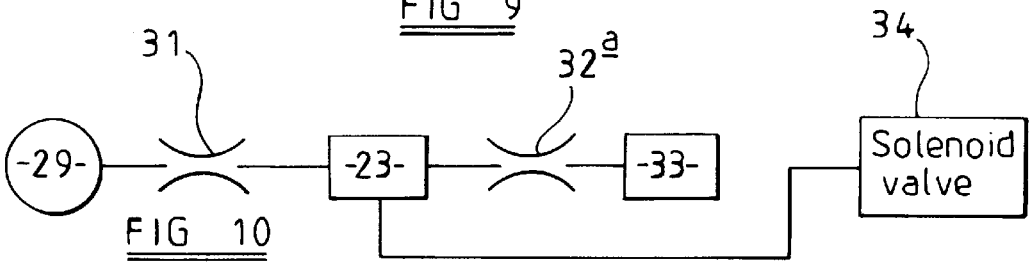

FIGS. 8, 9 and 10 are schematic representations respectively of the arrangements illustrated in FIGS. 1, 3 and 4. FIGS. 8, 9 and 10 are provided primarily for comparison with FIGS. 11 and 12 which show two additional embodiments. The arrangement shown in FIG. 11 is, in effect, a modification of the arrangement shown in FIG. 9 (and FIG. 3) whereas FIG. 12 is in effect a modification of the arrangement shown in FIG. 10 (and FIG. 4).

Figure 11:
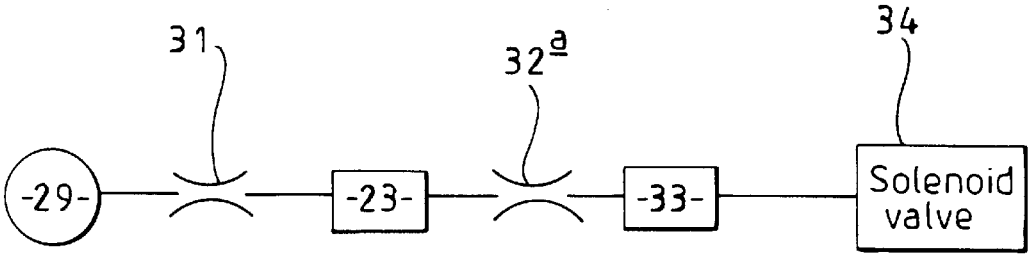
FIGS. 11 and 12 are views similar to FIGS. 9 and 10 of modifications thereof.

Comparing FIG. 11 with FIG. 9 it can be seen that the positions of the chambers 23 and 33 have been reversed in their relationship to the source 29 and solenoid valve 34. Thus in FIG. 11 the chamber 23 is supplied with fuel from the source 29 by way of the restrictor 31 and fuel reaches the solenoid valve 34 by way of the restrictor 32*a* and the chamber 33.

Similarly in FIG. 12 again the positions of the chambers 23 and 33 are reversed by comparison with those shown in FIG. 10. In FIG. 12 fuel is supplied to the chamber 33 from the source 29 through the restrictor 31 and chamber 33 supplies fuel to chamber 23 through the restrictor 32*a*. Fuel is spilled through the solenoid valve 34 from the chamber 33.

Figure 12:
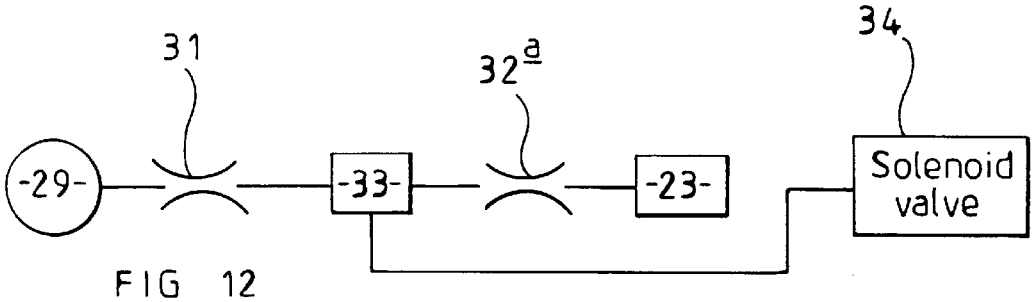

The provision of the arrangement shown in FIGS. 11 and 12, by comparison with those in FIGS. 8, 9 and 10, allows the selection of different operating characteristics for the fuel injection arrangement. In effect the system arrangement can be chosen to provide a desired "shape" of injection characteristics.

Figure 5:
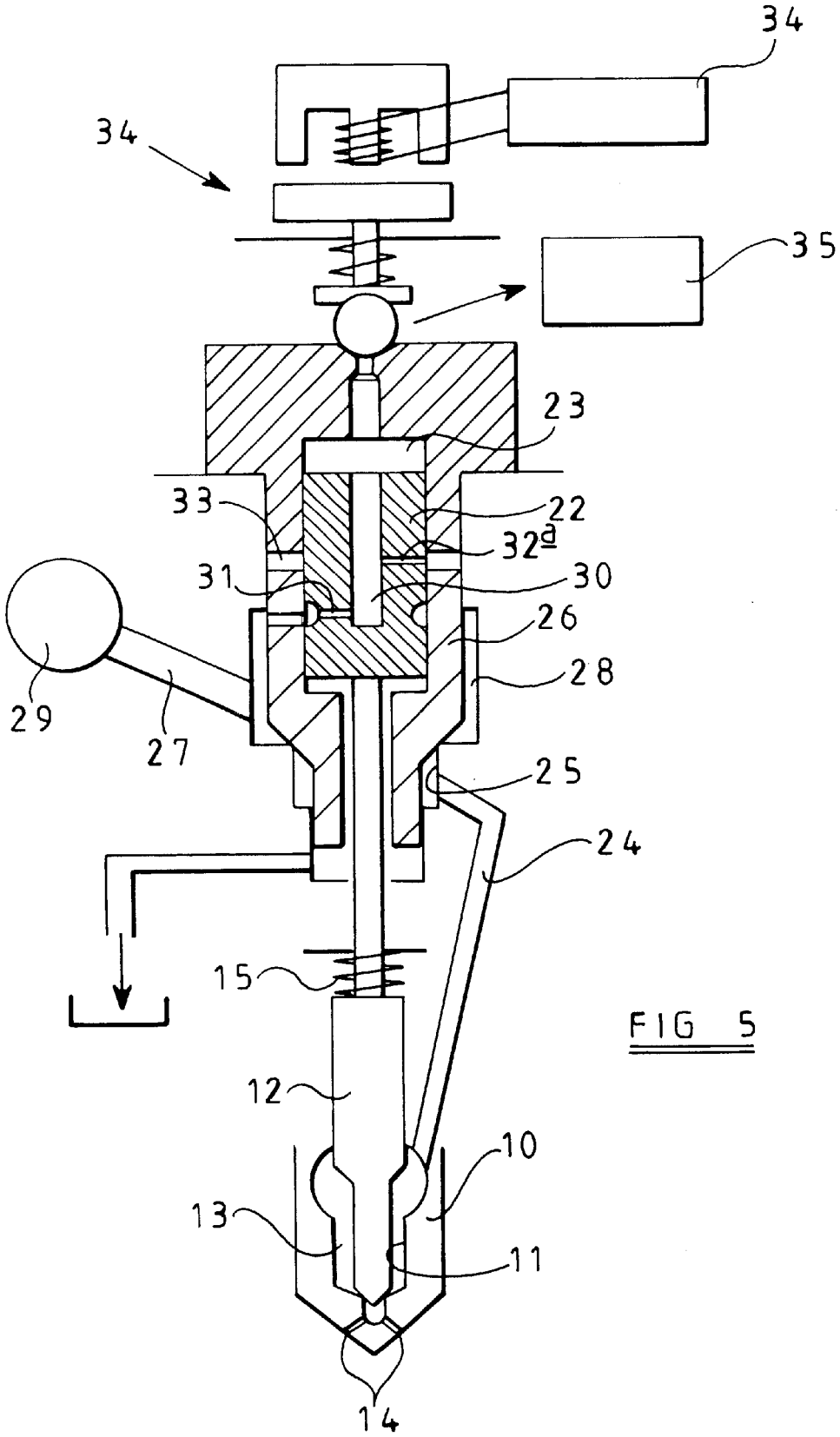
FIGS. 5 and 6 are diagrammatic sectional views of fuel injectors which operate in the same manner as the arrangement of FIG. 4.
Figure 6:
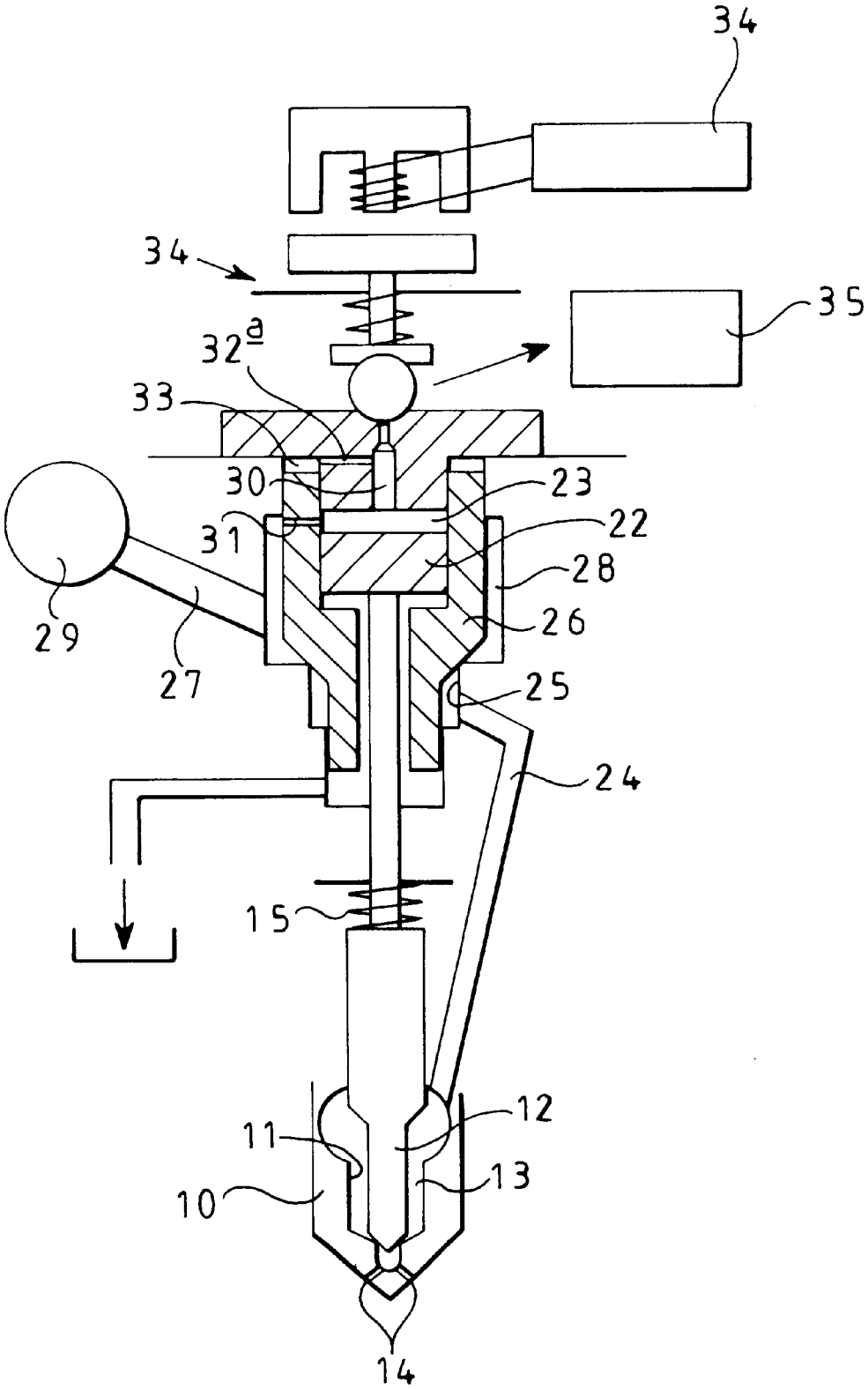

FIGS. 5 and 6 illustrate two implementations of the fuel injection arrangement of FIG. 4. In FIGS. 5 and 6, like reference numerals are used to denote parts which operate in a manner similar to those of FIG. 4. As illustrated in FIG. 5, a valve needle 12 is engageable with a seating to control delivery of fuel through one or more outlet openings 14 located downstream of the seating. The valve needle 12 is biased by a spring 15 into engagement with the seating, the action of the spring 15 being assisted by the action of fuel under pressure within a control chamber 23 defined, in part, by an upper surface of a piston member 22. An electromagnetically actuable valve 34 incorporating an electronically controlled solenoid drive unit 34*c* controls communication between the control chamber 23 and a low pressure fuel reservoir 35.

In the embodiment illustrated in FIG. 5, the piston member 22 is slidable within a bore formed in part of the valve member 26, the passage 30 and restrictions 31, 32*a* being formed in the piston member 22. As shown in FIGS. 5 and 6, the piston member 22 is preferably arranged to be substantially concentric with the control valve member 26.

As with the embodiment illustrated in FIG. 4, in the position illustrated, the electromagnetically actuated valve 34 occupies a closed position, thus the control chamber 23 and the chamber 33 are pressurized to a high pressure thereby ensuring that the control valve member 26 engages its seating and the needle 12 engages its seating. As a result, fuel under high pressure is not supplied to the delivery chamber, and injection of fuel is not taking place.

In order to commence injection, the electromagnetically actuable valve is energized to permit movement of the valve member thereof away from its seating and permitting fuel to escape from the control chamber 23 and from the chamber 33 through the restriction 32*a* to the low pressure fuel reservoir. As a result of the provision of the restriction 31, the rate at which fuel is able to flow to the chamber 33 and the control chamber 23 is insufficient to maintain the pressure therein, and as a result, the magnitude of the downward forces applied to the piston member 22 and the control valve member 26 are reduced. A point will be reached beyond which the control valve member 26 is able to lift away from its seating, thereby permitting fuel to flow from the source 29 to the delivery chamber 13, and beyond which the valve needle 12 is able to lift away from its seating against the action of the spring 15 and the fuel pressure within the control chamber 23. As a result, fuel injection takes place.

In order to terminate injection, the electromagnetically actuable valve is returned to the position shown. The continued supply of fuel through the restriction 31 results in the fuel pressure within the control chamber 23 rising rapidly, thus rapidly increasing the magnitude of the downward force applied to the needle 12 and causing the needle 12 to return into engagement with its seating, thus terminating the delivery of fuel by the injector. The fuel pressure within the chamber 33 rises at a reduced rate due to the presence of the restrictions 32*a*, but shortly after the valve needle 12 moves into engagement with its seating, thus fuel pressure within the chamber 33 will reach a point beyond which the control valve member 26 is able to move into engagement with its seating, thus terminating the supply of fuel to the delivery chamber 13. The arrangement illustrated in FIG. 6 is similar to that of FIG. 5 but in which rather than providing the restrictions 31, 32*a* within the piston member 22, the restriction 31 is provided within a portion of the control valve member 26, and the restriction 32*a* is provided within a part of the injector body which, in use, does not move relative to the nozzle 10. Operation of this embodiment is substantially as hereinbefore described with reference to FIGS. 4 and 5.

Figure 7:
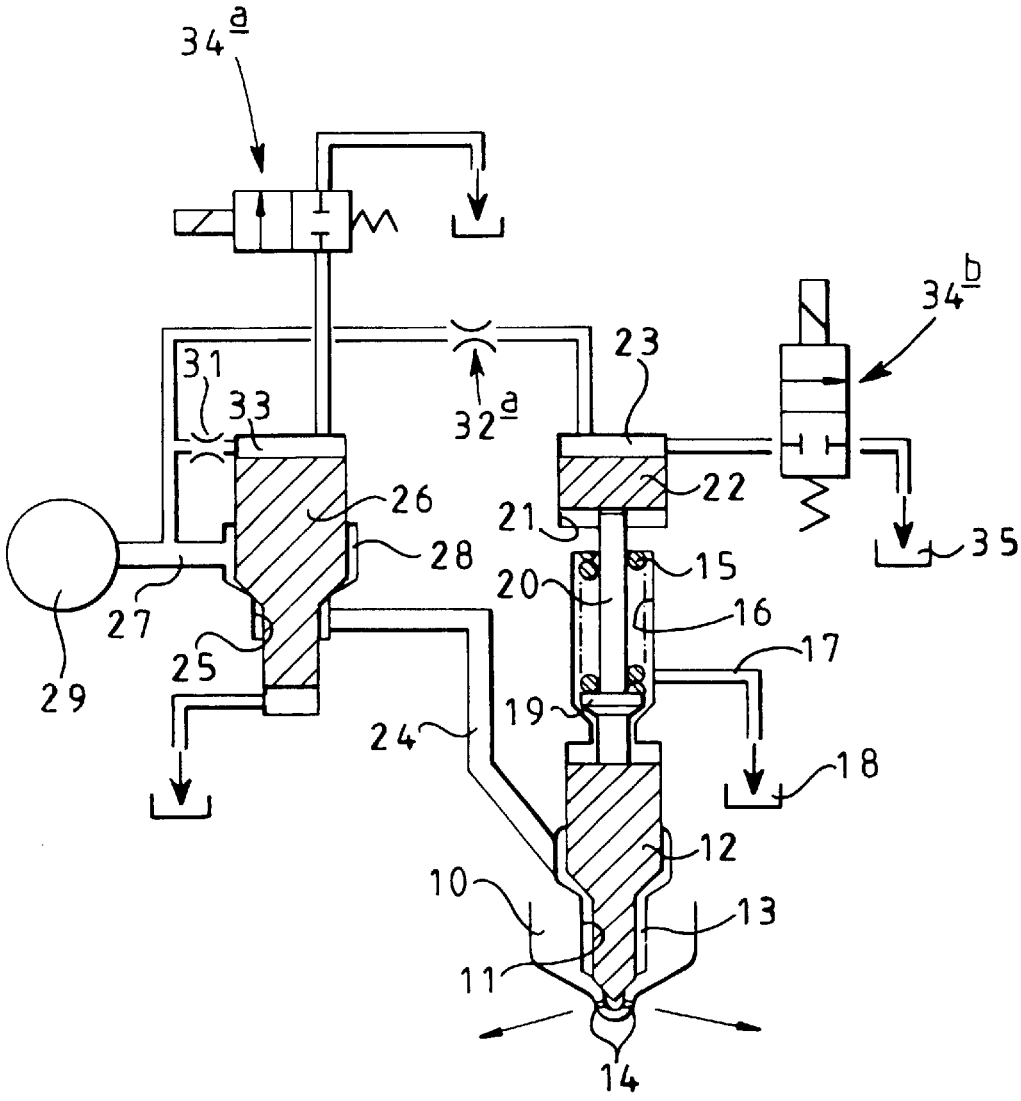
FIG. 7 is a view similar to FIG. 1 illustrating a further embodiment.

FIG. 7 illustrates an embodiment which is similar to those above, but in which separate electromagnetically actuable valves 34*a*, 34*b*, are arranged to control the fuel pressures within the chamber 33 and control chamber 23, respectively. Valves 34*a*, 34*b* can be arranged to receive the same operating signals (e.g. by being connected electrically in series) or can be arranged to be operated independently of one another. As a result, the relative timing of movement of the control valve member 26 and valve needle 12 can be controlled.

In each of the embodiments described hereinbefore, the fuel pressure within the passage 24 and delivery chamber 13 may be allowed to fall between injections. This may be achieved by replacing the control valve member 26 with a valve member forming part of a three-way valve arranged such that when communication is not permitted between the source 29 and the passage 24, the passage 24 communicates with a low pressure fuel reservoir. Alternatively, leakage between the valve needle 12 and the wall of the bore 11 may be sufficient to permit fuel to escape from the delivery chamber 13 to a low pressure fuel reservoir. As a further alternative, a passage containing a flow restriction may be provided between the delivery chamber and the low pressure fuel reservoir to permit fuel to escape from the delivery chamber 13 at a restricted rate.

As illustrated in FIGS. 5 and 6, in each of the embodiments described hereinbefore, the control valve member 26 and the valve needle 12 may be slidable within a common injector body. Alternatively, the control valve member 26 may form part of a valve located in a position spaced from the remainder of the injector body. Where the control valve member 26 is to be slidable within the same body as the valve needle 12, then conveniently the control valve member 26 and valve needle 12 are arranged concentrically as illustrated in FIGS. 5 and 6. It will be appreciated, however, that other relative positions are possible.

As described hereinbefore, the fuel injector arrangement of the invention is advantageous in that continuous fuel injection can be avoided where either one or the other of the control valve member 26 and the valve needle 12 become stuck in a lifted position. It will be appreciated that if either the control valve member 26 or the valve needle become stuck in a partially lifted position, then injection of fuel will be possible at a reduced rate. Continuous injection of fuel is possible in the event that the electromagnetically actuable valve 34 fails in an open position. However, such a failure may be detected relatively easily and appropriate action taken to shutdown the fuel system.

In the arrangements described herein with reference to FIGS. 3 to 12 the rate of injection characteristic of the arrangement can be "shaped" by selection of the sizing of the restrictor 32*a*. The sizing of the restrictor 32*a* determines the rate at which fuel is spilled in use by the control valve 26 to the reservoir 35 (by way of valve 34) and thus controls the rate at which fuel pressure rises and falls at the nozzle 10–14.

The invention is especially applicable to fuel systems intended for use in supplying fuel to large engine installations such as used in marine applications or in industrial power plants. It will be appreciated, however, that the invention is not restricted to the use of the fuel injector arrangement in such applications.

It will further be appreciated that although the fuel injector arrangement in the accompanying figures is shown to include a solenoid actuable valve (34), the actuator may be of an alternative type, for example a piezoelectric actuator.

What is claimed is:

1. A fuel injector arrangement comprising in combination:

a nozzle provided with a first bore within which a valve needle is slidable, the needle being engageable with a seating to control the flow of fuel from a delivery chamber to an outlet opening, a control chamber supplied with fuel at the high pressure from the high pressure fuel source, a surface associated with the needle being exposed to pressure in the delivery chamber;

a two port fuel pressure actuatable control valve having a first port connected to the high pressure fuel source;

a passage connecting the second port of the control valve to the delivery chamber; and, the control valve responding to fuel pressure actuation to supply high pressure fuel through the passage to the delivery chamber in a first position, and in a second position to close said passage.

2. The fuel injector arrangement as claimed in claim 1, further comprising a solenoid actuable valve to control the fuel pressure within the control chamber, thereby controlling the timing of movement of the valve needle.

3. The fuel injector arrangement as claimed in claim 2, wherein the solenoid actuable valve is also arranged to control the fuel pressure applied to the fuel pressure actuable control valve.

4. The fuel injector arrangement as claimed in claim 1, further comprising a further chamber defined, in part, by a surface of a control valve member forming part of the fuel pressure actuable control valve.

5. The fuel injector arrangement as claimed in claim 4 wherein the delivery chamber communicates with a further bore within which the control valve member is slidable, the further bore defining a further seating with which the control valve member is engageable to control communication between the delivery chamber and a source of fuel at high pressure.

6. The fuel injector arrangement as claimed in claim 5, wherein the further bore defines a second chamber in communication with the source of fuel at high pressure, communication between the second chamber and the delivery chamber being permitted when the control valve member is moved away from the further seating.

7. The fuel injector as claimed in claim 6 wherein the control valve member is arranged such that the application of fuel under pressure to the further chamber applies a force to the control valve member which serves to urge the control valve member into engagement with the further seating to prevent communication between the source and the delivery chamber.

8. The fuel injector as claimed in claim 1, further comprising a piston member which is moveable with the valve needle, a surface of the piston member being exposed to fuel pressure within the control chamber.

9. The fuel injector as claimed in claim 8 wherein the piston member is arranged to be substantially concentric with the control valve member.

10. The fuel injector as claimed in claim 8 wherein the piston member and the control valve member are arranged such that one is slidable within the other.

11. The fuel injector as claimed in claim 1, further comprising a flow restrictor which is arranged to restrict the flow of fuel to the delivery chamber.

12. The fuel injector arrangement as claimed in claim 1, further comprising a restriction for restricting fuel flow to the control chamber.

13. The fuel injector arrangement as claimed in claim 1, further comprising a further restriction for restricting fuel flow from a further chamber to the control chamber, the further chamber being defined, in part, by a surface of a control valve member forming part of the fuel pressure actuable valve.

14. The fuel injector arrangement as claimed in claim 13, wherein the restriction and the further restriction are formed within a piston member which is moveable with the valve needle, a surface of the piston member being exposed to fuel pressure within the control chamber.

15. The fuel injector arrangement as claimed in claim 12 wherein the restriction is formed within a portion of a control valve member forming part of the fuel pressure actuable control valve.

16. The fuel injector arrangement as claimed in claim 1, wherein the fuel pressure actuable control valve and the solenoid actuable valve are mounted upon or form part of a fuel injector of which the nozzle forms a part.

17. The fuel injector arrangement as claimed in claim 1, further comprising a passage in communication with a source of fuel at high pressure, wherein the passage communicates directly with a further chamber, the further chamber being defined, in part, by a surface of a control valve member forming pat of the fuel pressure actuable control valve.

18. The fuel injector arrangement as claimed in claim 1, wherein the fuel pressure actuable control valve and the solenoid actuable valve are mounted upon or form part of a fuel injector of which the nozzle forms a part.

19. A fuel injector arrangement comprising:

a nozzle provided with a first bore within which a valve needle is slidable, the needle being engageably with a seating to control the flow of fuel from a delivery chamber to an outlet opening, the delivery chamber supplied with fuel at a high pressure from a high-pressure fuel source, a control chamber supplied with fuel at the high pressure from the high-pressure fuel source, a surface associated with the needle being exposed to the high pressure within the control chamber;

a fuel pressure actuable control valve controlling the supply of fuel from said high pressure fuel source to the delivery chamber; and, first and second separate solenoid actuable valves for controlling fuel pressure applied to the fuel pressure actuable valve and fuel pressure within the control chamber respectively.

20. A fuel injector arrangement, comprising:

a source of pressurized fuel;

a nozzle coupled to the source of pressurized fuel, the nozzle forming a bore;

a valve needle disposed within the bore and being slidable between an open position and a closed position, the nozzle and the valve needle forming a delivery chamber, wherein the valve needle is adapted to permit fluid flow from the delivery chamber to an outlet opening when in the open position and to restrict fluid flow from the delivery chamber to the outlet opening when in the closed position; and a two port fuel pressure actuable control valve having a first port coupled to the source of pressurized fuel, and a second port coupled to the delivery chamber such that in one condition the control valve connects the first and second ports for flow of fuel to the delivery chamber, and in a second condition, said valve disconnects said ports so that said flow is terminated.

21. A fuel injector arrangement, as set forth in claim 20, wherein the nozzle and the valve need form a control chamber, and where the fuel injector arrangement includes a solenoid actuable valve adapted to control fuel pressure within the control chamber.

22. A fuel injector arrangement, as set forth in claim 21, further including a second solenoid actuable valve adapted to control the fuel pressure actuable control valve.

* * * * *